US005267869A

United States Patent [19]

Nadasky et al.

[11] Patent Number: 5,267,869

[45] Date of Patent: Dec. 7, 1993

[54] IGNITION CABLE ASSEMBLY AND METHOD OF MAKING SAME

[75] Inventors: Suzanne C. Nadasky; Michael J. Bezusko, both of Warren, Ohio

[73] Assignee: General Motors Corporation, Detroit, Mich.

[21] Appl. No.: 990,478

[22] Filed: Dec. 14, 1992

[51] Int. Cl.[5] ..... H01R 13/53

[52] U.S. Cl. ..... 439/125; 29/859; 123/169 PH; 439/932

[58] Field of Search ..... 439/125, 127, 128, 893, 439/932; 123/143 C, 169 PH; 29/859

[56] References Cited

U.S. PATENT DOCUMENTS

| | | | |
|---|---|---|---|
| 3,662,094 | 5/1972 | Wetmore et al. | 439/932 X |
| 3,963,295 | 6/1976 | Askman et al. | 439/932 X |
| 4,009,924 | 3/1977 | Bungo et al. | 339/223 |
| 4,209,221 | 6/1980 | Chupak et al. | 339/223 |
| 4,906,202 | 3/1990 | Germ | 439/127 |

OTHER PUBLICATIONS

*Semirigid Flame-Retarded Heat-Shrinkable Tubing* published by Raychem Corp., Thermofit Systems Division, Feb., 1990.

*Innovative Technologies For Today . . . and Tomorrow* published by Raychem Corp., Automotive Division, May 1990.

*Primary Examiner*—Eugene F. Desmond

*Attorney, Agent, or Firm*—William A. Schuetz

[57] ABSTRACT

Several variations of ignition cable assemblies that have a cable seal and a tower seal enclosing a terminal and a heat shrunk sleeve and their method of manufacture are disclosed. The cable seal insulates a substantial portion of the terminal to increase the dielectric strength of the assembly. The tower seal includes an elastomeric boot that is radially spaced from the contact of the terminal to sealingly engage an outer surface of a male or female tower. The heat shrunk sleeve forms at least part of the cable seal and it may be used to provide an angled dress for the ignition cable or to accommodate an angled terminal.

20 Claims, 3 Drawing Sheets

FIG-7
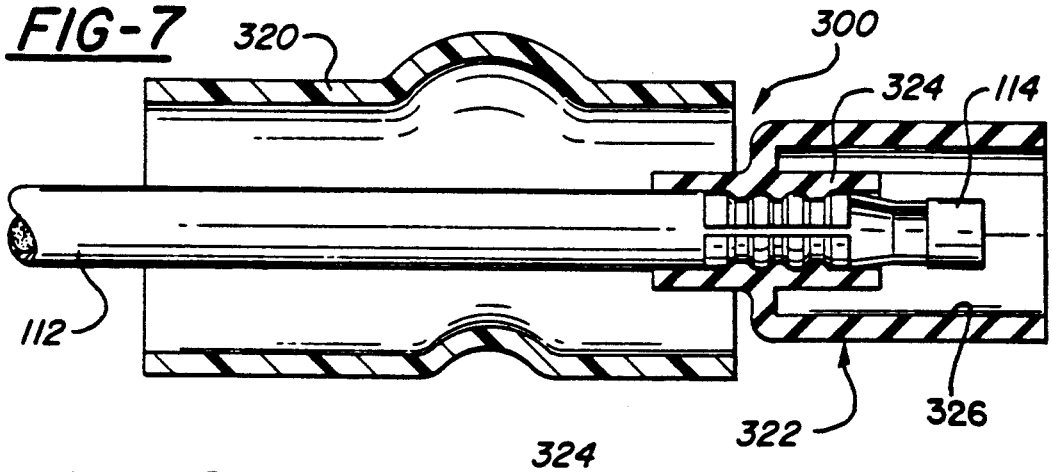
FIG-8
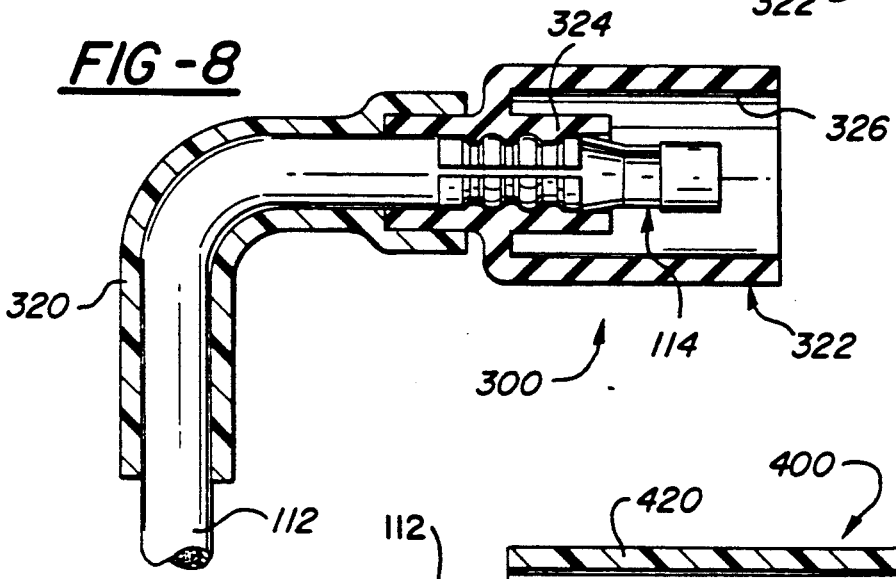
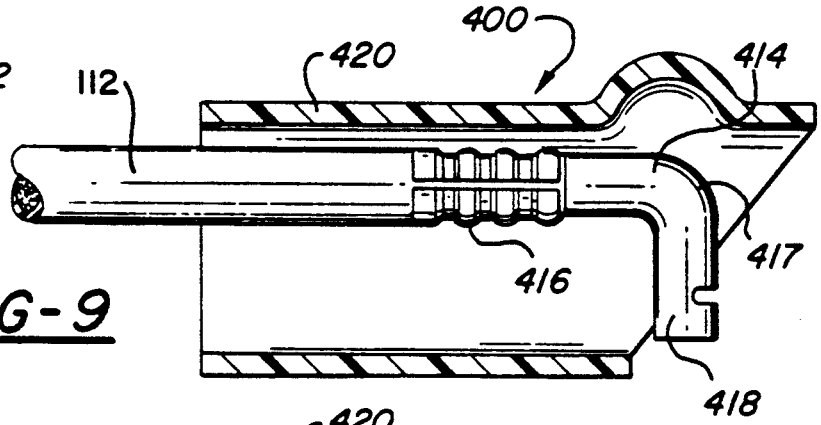
FIG-9
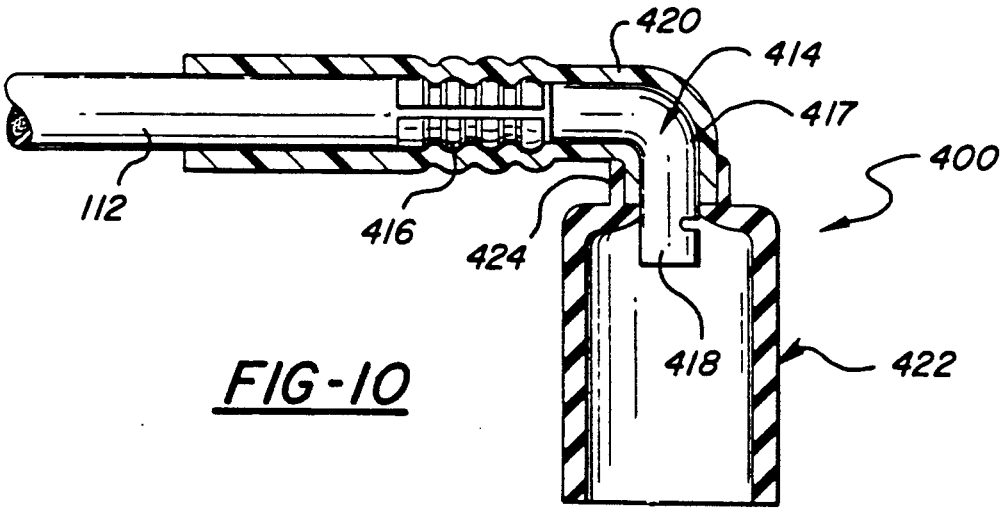
FIG-10

IGNITION CABLE ASSEMBLY AND METHOD OF MAKING SAME

BACKGROUND OF THE INVENTION

This invention relates to ignition cable assemblies and more specifically to ignition cable assemblies that have a terminal attached to the end of the ignition cable and encased within a flexible elastomeric nipple or boot that provides the primary environmental seal and dielectric insulation for the terminal when it is connected to a mating terminal.

One known method of extending the dielectric capability of such an ignition cable assembly involves the use of a close fitting insulation sleeve. The sleeve is manufactured as a separate part of rigid, dielectric insulator material such as polyester, and inserted into the elastomeric boot. When inserted, this sleeve insulates a substantial portion of the terminal inside the elastomeric boot so that the dielectric arc over distance to ground is significantly increased when the ignition cable terminal is connected to a coil, distributor or spark plug, particularly when the mating terminal is located in a female insulating tower. The resulting increased dielectric capability increases long term reliability.

While this method does improve reliability, nevertheless, this method has several drawbacks. The manufacture of a separate insert sleeve adds cost and complexity to the manufacturing process. Moreover, automated assembly is limited to straight cable assemblies having straight terminals and a straight cable dress whereas an angled terminal and/or an angled cable dress is needed or desired in many ignition cable assembly applications. Furthermore, interior space limitations of the elastomeric boot require tight manufacturing tolerances for the plastic sleeve that are difficult to maintain.

SUMMARY OF THE INVENTION

The object of this invention is to provide an ignition cable assembly that has a substantial portion of the terminal insulated by a close fitting sleeve to increase dielectric strength but that does not require insertion of a separate sleeve of precise manufacture into an elastomeric boot or tower seal.

Another object of this invention is to provide an ignition cable assembly of high dielectric strength that is easily manufactured.

Another object of this invention is to provide an ignition cable assembly that is easily manufactured to accommodate an angled terminal.

Another object of this invention is to provide an ignition cable assembly that is easily manufactured to provide an angled cable dress.

Still another object of this invention is to provide an ignition cable assembly that has its dielectric strength increased by a close fitting insulation sleeve that does not require tight manufacturing tolerances to fit onto a terminal and/or to fit inside an elastomeric boot.

A feature of the invention is that a heat shrinkable tube is used to provide improved dielectric strength characteristics and/or manufacturing advantages particularly when an angled terminal or cable dress is desired.

BRIEF DESCRIPTION OF THE DRAWINGS

The above and other objects, features and advantages of the invention will become more apparent from the following description taken in conjunction with the accompanying drawings wherein like references refer to like parts and wherein:

FIG. 7 is a partially sectioned view of still another version of an ignition cable assembly of this invention during its process of manufacture;

FIG. 8 is a partially sectioned longitudinal view of the ignition cable assembly of FIG. 7 at a later stage of manufacture;

FIG. 9 is a partially sectioned view of yet another version of an ignition cable assembly of this invention during its process of manufacture; and FIG. 10 is a partially sectioned longitudinal view of the ignition cable assembly of FIG. 9 at a later stage of manufacture.

DESCRIPTION OF THE INVENTION

Figure 1:
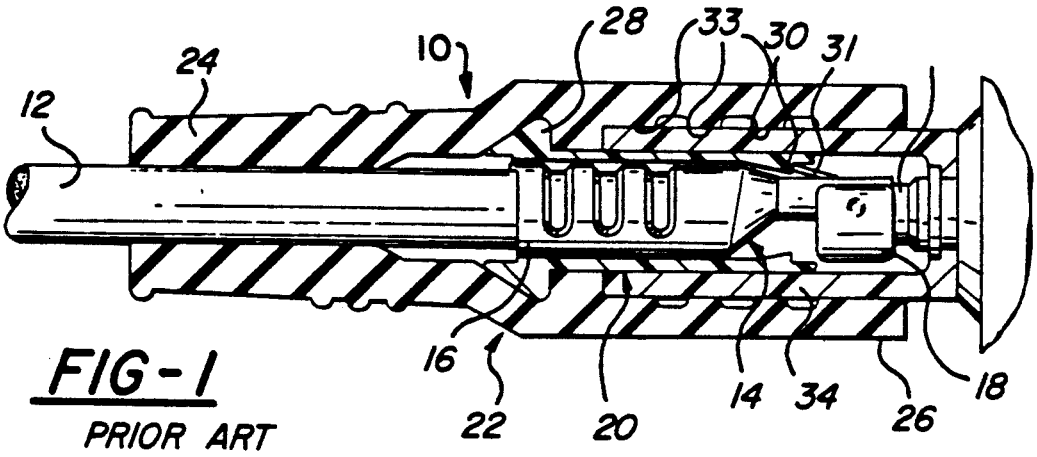
FIG-1 PRIOR ART
FIG. 1 is a longitudinal section of a prior art ignition cable assembly connected to a mating terminal located in a female tower.

Referring now to the drawing, FIG. 1 discloses a prior art ignition cable assembly 10 comprising an ignition cable 12 that has a terminal 14 attached to one end. The terminal 14 has a crimp barrel 16 at one end that is attached to the end of the ignition cable 12 and a contact 18 at the other end that is in the form of a two-piece resilient socket of the type that is generally shown in U.S. Pat. No. 4,009,924 granted to Edward M. Bungo and Lloyd D. Jack Mar. 1, 1977.

The ignition cable assembly 10 has a close fitting insulation sleeve 20 and a flexible elastomeric nipple or boot 22 that provides the primary environmental seal and dielectric insulation for the terminal when it is connected to a mating terminal. The elastomeric boot 22 has a sleeve portion 24 at one end and a larger diameter socket portion 26 at the other end. The sleeve portion 24 fits tightly around the ignition cable 12 behind the terminal 14 which is housed in the socket portion 26. The interior of the socket portion 26 has a plurality of axially spaced, resilient sealing ribs and a wedge shaped annular groove at its inner end.

The insulation sleeve 20 is a separate piece that is made of rigid dielectric material, such as polyester, that is inserted into the open end of the socket portion 26 and locked in place by lock nibs 28 that fit into the wedge shaped groove at the inner end of the socket portion 26. When inserted the insulation sleeve 20 fits closely around the terminal 14 to insulate a substantial portion of the terminal 14 that is inside the socket portion 26 of the boot 22. In this case the entire crimp barrel 16 and nearly all of the transition between the crimp barrel 16 and the socket contact 18 are insulated by the sleeve 20.

The interior of the insulation sleeve 20 has an annular lock ramp 30 that is engaged by a latch finger 31 that is part of the socket contact 18 to prevent withdrawal of the terminal 14.

The ignition cable assembly 10 is plugged onto a stud terminal 32 that is located in the bottom of a female tower 34 of dielectric material. The stud terminal 32 and female tower 34 are representative of those found on ignition system components such as coils, distributors and spark plugs. In any event, when the ignition cable assembly 10 is fully engaged, the female tower 34 is inside the socket portion 26 of the elastomeric boot 22 where the resilient sealing lips 33 inside the socket portion 26 are biased into sealing engagement with the outer periphery of the female tower 34 to provide an environmental seal. In addition, the insulation sleeve 20 fits closely around most of the terminal 14 inside the female tower 34 leaving only the terminal contacts deep inside the female tower 34 exposed. Consequently, the insulation sleeve 20 increases the dielectric arc over distance to ground significantly to increase the dielectric capability and long term reliability of this prior art ignition cable assembly 10 as indicated above.

Figure 2:
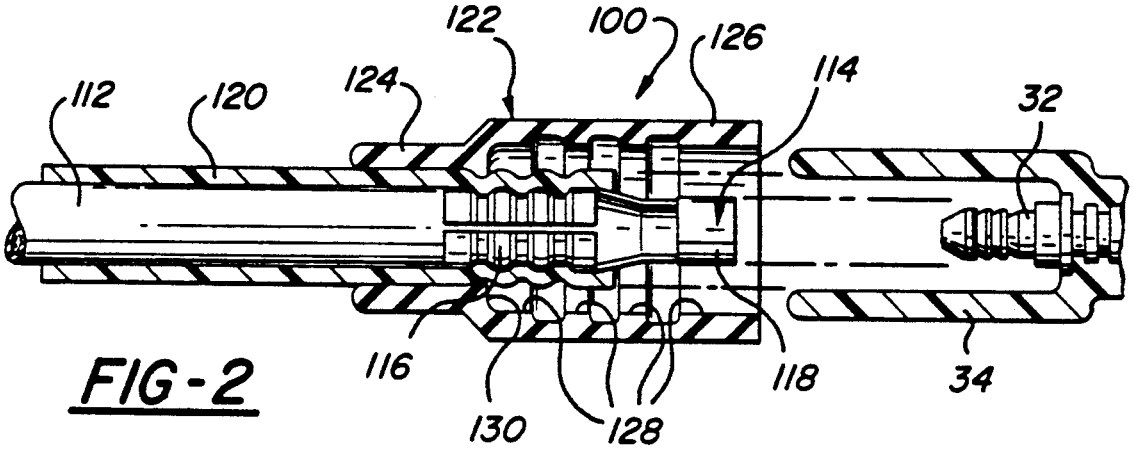
FIG. 2 is a longitudinal section of an ignition cable assembly of this invention positioned for connection to a mating terminal located in a female tower.
Figure 3:
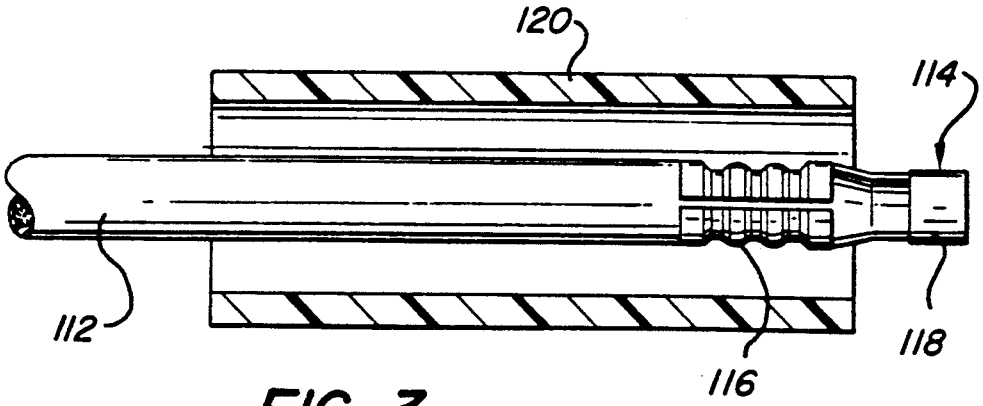
FIG. 3 is a partially sectioned longitudinal view of the ignition cable assembly of FIG. 2 in the process of being manufactured.

An improved ignition terminal assembly 100 of this invention is shown in FIGS. 2 and 3. The ignition cable assembly 100 comprises an ignition cable 112 that has a terminal 114 attached to one end. The terminal 114 has a crimp barrel 116 at one end that is attached to the end of the ignition cable 112 and a contact 118 at the other end that is in the form of a resilient socket. The terminal 114 is an improved simplified design in that latch finger 31 of the prior art design shown in FIG. 1 is eliminated.

The ignition cable assembly 100 has a two piece seal comprising a cable seal 120 and a tower seal 122.

The cable seal 120 is a sleeve of dielectric heat shrinkable material that is heat shrunk onto the crimp barrel 116 at the attachment end of the terminal 114 and end of the ignition cable 112 with a substantially air tight fit as shown in FIG. 2. The heat shrinkable sleeve is applied as a oversized sleeve that has a shape memory of a cylindrical tube that is smaller in diameter than the crimp barrel 116 of the terminal 114 and ignition cable 112. The terminal 114 and the end of the ignition cable 112 are inserted into this oversize sleeve until the socket contact 118 protrudes out the end as shown in FIG. 3. For example a suitable proportion might be a sleeve having an inside diameter of about 12.7 mm for a 7.0 mm ignition cable. In any event the oversize sleeve is then heated by convection airflow or other suitable means so that it shrinks tightly around the end of the ignition cable 112, the terminal crimp barrel 116 and part of the terminal transition between the crimp barrel 116 and the socket contact 118 as shown in FIG. 2. The heat shrunk sleeve 120 forms an air tight wrap so that air does not contact the covered surfaces of the terminal 114. The heat shrunk sleeve 120 also preferably covers as much of the terminal transition as practicable.

Suitable heat shrink sleeves of various materials having suitable dielectric insulating properties and thermal operating ranges are commercially available, one such sleeve being heat shrinkable Thermofit CRN tubing marketed by Raychem Corporation of Menlo Park, Calif. The tubing is described as a semirigid, flame-retarded heat-shrinkable tubing that is fabricated from radiation-crosslinked polyolefin and that has a minimum shrink temperature of 135 degrees centigrade and continuous operating temperature from −55 degrees centigrade to 135 degrees centigrade.

The heat shrunk sleeve 120 improves the dielectric strength of ignition cable assembly in comparison to the prior art ignition terminal assembly discussed above because it excludes air contact with a substantial portion of the terminal 114 thereby eliminating the potential for damaging ionization of the air around the insulation material of the sleeve. Elimination of this ionized air and the simplified terminal design reduces electrical field stress at the termination and allows for a significant reduction in the wall thickness of the dielectric insulation material in the sleeve 120.

Another benefit is that the application of the heat shrunk sleeve 120 snugly around the end of the ignition cable 112 and terminal crimp barrel 116 provides a good strain relief between the terminal 114 and cable 112 that reduces the potential for terminal pull off during servicing substantially.

The heat shrunk sleeve can be flexible, semi-rigid or rigid depending on application requirements. For instance, an ignition cable assembly designed for use with engines having spark plugs disposed in deep wells could have a rigid heat shrunk sleeve of considerable length so that the terminal at the end of the ignition cable assembly could be plugged onto the spark plug terminal deep in the engine well easily.

The tower seal 122 is an elastomeric boot or nipple that has a sleeve portion 124 at one end and a larger diameter socket portion 126 at the other end. The sleeve portion 124 fits tightly around the heat shrunk sleeve 120 at the end of the ignition cable 112 as shown in FIG. 2. The sleeve portion 124 may overlap the end of the crimp barrel 116 a small amount so long as the female tower 34 fits into the socket portion 126 which houses the terminal 114.

The interior of the socket portion 126 has a plurality of axially spaced, resilient sealing ribs 128 and an annular stop shoulder 130 at its inner end.

The ignition cable assembly 100 is plugged onto the stud terminal 32 that is located in the bottom of the female tower 34 of dielectric material. As indicated above, the stud terminal 32 and female tower 34 are representative of those found on ignition system components such as coils, distributors and spark plugs. When the ignition cable assembly 100 is fully engaged, the female tower 34 is inside the socket portion 126 of the tower seal 120 where the resilient sealing lips 128 are biased into sealing engagement with the outer periphery of the tower 34 to seal out the environment. Moreover the heat shrunk sleeve 120 that covers the crimp barrel 116 and terminal transition is inside the female tower 34 so that only the terminal contacts 114, 32 deep inside the female tower 34 are exposed. Consequently, the heat shrunk sleeve 120 also increases the dielectric arc over distance to ground significantly to increase the dielectric capability and long term reliability of the ignition cable assembly 100 as well. Moreover it provides this capability without need for a precisely sized plastic sleeve that is difficult to insert in the elastomeric tower seal 126 as is the case with the prior art ignition cable assembly 10.

Figure 4:
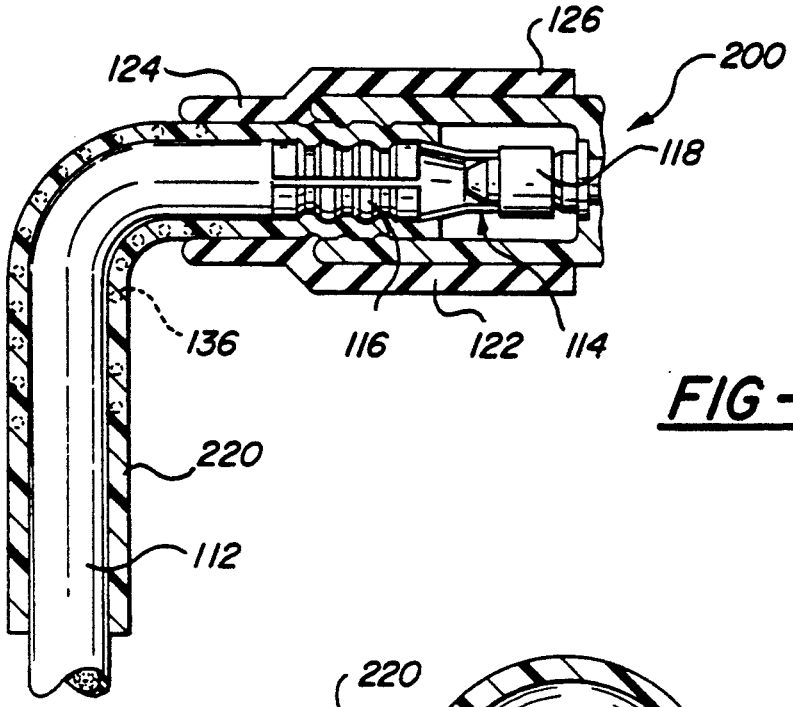
FIG. 4 is a longitudinal sectional view of another version of an ignition cable assembly of the invention.
Figure 5:
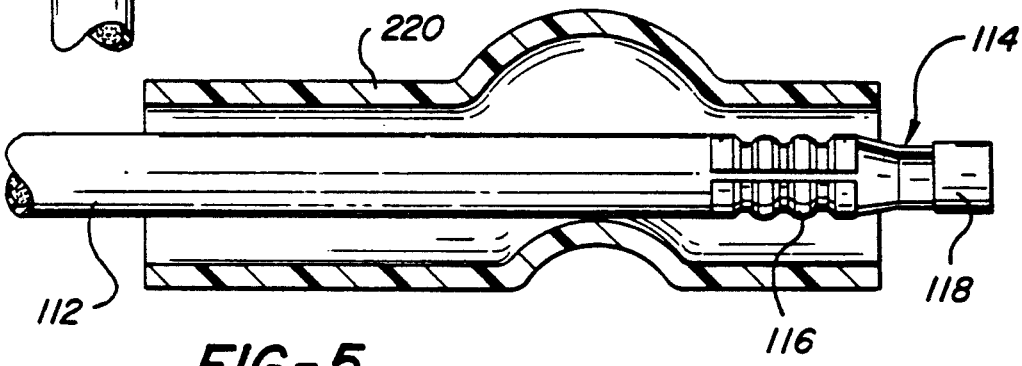
FIGS. 5 and 6 are partially sectioned longitudinal views of the ignition cable assembly of FIG. 4 during various stages of manufacture.
Figure 6:
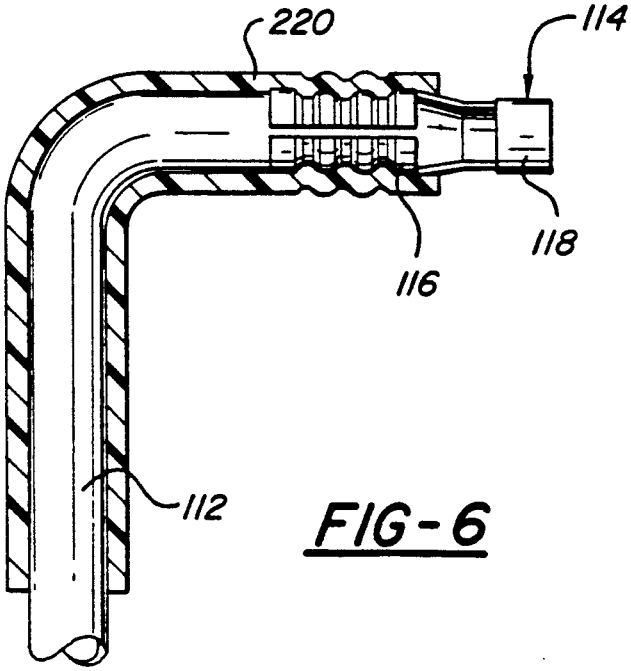

Another big advantage of the invention is that it can provide an angled dress for the ignition cable easily as shown in FIGS. 4, 5 and 6.

The ignition cable assembly 200 that is shown in these figures comprises an ignition cable 112, a terminal 114 and a tower seal 122 that are identical to those of the straight ignition cable assembly 100 shown in FIGS. 2 and 3. The only component that is different is the heat shrunk sleeve 220 that has a shape memory that includes a right angle elbow. Consequently the sleeve 220 provides a right angle dress for the ignition cable 112 when it is heat shrunk onto the end of the ignition cable 112 and attachment barrel of the terminal 114 as shown in FIG. 4.

The manufacture of the ignition cable assembly 200 is basically the same as the manufacture of the ignition cable assembly 100. The ignition cable 112 with the terminal 114 attached to the end of the ignition cable 112 is inserted into an oversize heat shrinkable sleeve 220 until the socket contact 118 of the terminal 114 projects out the end of the oversize sleeve as shown in FIG. 5. The oversize sleeve 220 is then heated until it shrinks onto the end of the ignition cable 112 and the attachment end of the terminal 114 with a tight fit. During the shrinking process, the sleeve 220 also bends the ignition cable 112 at a right angle due to its shape memory as shown in FIG. 6. The right angled subassembly of FIG. 6 is then inserted into the tower seal 122 via the sleeve portion 124 to form the ignition cable assembly 200 shown in FIG. 4. In this regard it should be noted that the portion of the right angled subassembly that is inserted into the tower seal 122 is linear. This insertion of one straight part into another straight part simplifies the assembly procedure significantly and makes automated assembly possible.

In the ignition cable assembly 200 and method of manufacture described above, the sleeve 220 itself bends the ignition cable 112 as it is heat shrunk. However it is also possible to use a shape memory insert, such as the spring 136 that is shown in phantom in FIG. 4, to bend the ignition cable 112 or to assist the sleeve 220 in bending the ignition cable 112. In this event, a helixical spring that has a shape memory which includes an elbow portion is incorporated in a heat shrinkable sleeve that is generally cylindrical so that the ignition cable and terminal can be inserted into it easily before it is heat shrunk. The spring 136 or other suitable insert then takes its shaped memory configuration as shown in FIG. 4 as the sleeve is heated so that the spring 136 or insert bends or assists the sleeve 220 in bending the ignition cable as the sleeve shrinks. One type of insert is a metallic shape memory spring commercially available from Raychem Corporation and made with Tinel which Raychem Corporation describes as a nickel-titanium alloy.

Another version of an ignition cable assembly of this invention is disclosed in connection with FIGS. 7 and 8. In this version the insulation sleeve for the terminal is part of the tower seal while the heat shrinkable sleeve is used primarily for providing a right angle dress for the ignition cable.

More specifically the ignition cable assembly 300 comprises an ignition cable 112 that has a terminal 114 attached to one end in the same manner as the earlier versions. In this instance, however, the tower seal 322 has a sleeve portion 324 that extends inside the socket portion 326. The ignition cable 112 and attached terminal 114 are inserted into this sleeve portion 324 in a linear fashion until the socket contact 118 of the terminal is properly positioned as shown in FIG. 7. During the manufacturing process, the ignition cable 112 and attached terminal 114 are disposed inside an enlarged heat shrinkable sleeve 320 (that has a shape memory that includes a right elbow) so that nearly all the terminal 114 projects out the end of the heat shrinkable sleeve 320 as shown in FIG. 7. The ignition cable 112 and attached terminal 114 are preferably inserted partially through the enlarged heat shrinkable sleeve 320 before the tower seal 322 is attached, however this is not absolutely necessary. In any event the enlarged heat shrinkable sleeve 320 is heated with the tower seal 322 attached and positioned as shown in FIG. 7 so that the sleeve 320 shrinks tightly around the ignition cable 112 and the exterior part of the sleeve portion 324 of the tower seal 322. During the shrinking process, the sleeve 320 bends the ignition cable 112 to provide a right angle dress as shown in FIG. 8. The heat shrunk sleeve 320 also squeezes the exterior part of the sleeve portion 324 to enhance the cable seal that the heat shrunk sleeve 320 provides in part.

The socket portion 326 is shown with a smooth interior but it may include internal seal lips as in the case of the earlier tower seals 122.

Still another version of an ignition cable assembly of this invention is disclosed in FIGS. 9 and 10. This version accommodates a right angle terminal for those applications where such a terminal is needed or desired. More specifically the ignition cable assembly 400 has a right angle terminal 414 that has a crimp barrel 416 at one end, a socket contact 418 at the other end and a transition that includes a right elbow 417. The terminal 414 is attached to the end of an ignition cable 112 in a conventional manner. This subassembly is then inserted into an oversize heat shrinkable sleeve 420 that has a shape memory that includes a right elbow portion. The heat shrinkable sleeve 420 is generally cylindrical and large enough so that the subassembly can be inserted partially through the heat shrinkable sleeve 420 terminal end first to the position shown in FIG. 9. The sleeve 420 is then heated until it fits tightly around the ignition cable 112, the terminal crimp barrel 416 and the elbow 417 as shown in FIG. 10. The heat shrunk sleeve 420 provides a close fitting, air tight insulation sleeve for most of the terminal 414. It also provides an excellent cable seal as well as an extremely strong strain relief.

The ignition cable assembly 400 is then completed by mounting a sleeve portion 424 of a tower seal 422 onto the straight portion at the end of the heat shrunk sleeve 420 which is also an easy procedure to automate.

The several examples of the invention that are shown and describe above all have female terminals with socket contacts that are plugged onto a male stud terminal. However, it should be understood that the invention also applies to ignition cable assemblies that have male terminals that plug into female terminals of the ignition system components. Similarly the invention also applies to ignition cable assemblies that are plugged onto male towers even though the examples all show female towers. Moreover, even though examples show and disclose ignition cable terminal assemblies having a right angle ignition cable dress or a right angle terminal, the invention also applies to ignition cable assemblies that have ignition cables that are dressed at other angles or terminals that incorporate other angles.

In other words, the invention has been described in an illustrative manner, and it is to be understood that the terminology which has been used is intended to be in the nature of words of description rather than of limitation.

Obviously, many modifications and variations of the present invention in light of the above teachings may be made. It is, therefore, to be understood that, within the scope of the appended claims, the invention may be practiced otherwise than as specifically described.

The embodiments of the invention in which an exclusive property or privilege is claimed are defined as follows:

1. A sealed ignition cable assembly comprising:

a terminal attached to an end of an ignition cable, a cable seal and a tower seal for enclosing the terminal, the cable seal insulating a substantial portion of the terminal, the tower seal including an elastomeric boot that is radially spaced from a contact of the terminal to sealingly engage an outer surface of an insulation tower for a mating terminal, and a heat shrunk sleeve that forms at least part of the cable seal.

2. A sealed ignition cable assembly comprising:

a terminal having a contact end and an attachment end, the attachment end being attached to an end of an ignition cable, a heat shrinkable sleeve of electrically insulative material shrunk onto the end of the cable and the attachment end of the terminal, and an elastomeric boot mounted on the sleeve and disposed in a radially spaced relationship around the contact end of the terminal.

3. The sealed ignition cable assembly as defined in claim 2 wherein the sleeve has a shape memory that is straight and the terminal is straight.

4. The sealed ignition cable assembly as defined in claim 2 wherein the heat shrunk sleeve has a curved portion that dresses the ignition cable at an angle.

5. The sealed ignition cable assembly as defined in claim 2 wherein the sleeve has a shape memory that includes a curved portion so that the ignition cable is dressed at an angle when the sleeve is shrunk onto the ignition cable.

6. The sealed ignition cable assembly as defined in claim 2 wherein the sleeve includes a spring or insert that has a shape memory that is curved so that the ignition cable is dressed at an angle when the sleeve is shrunk onto the ignition cable.

7. The sealed ignition cable assembly as defined in claim 4 wherein the terminal is straight.

8. The sealed ignition cable assembly as defined in claim 4 wherein the terminal has an angled transition between the attachment end and the contact end.

9. A sealed ignition cable assembly comprising:

a terminal having a contact end and an attachment end, the attachment end being attached to an end of an ignition cable, a cable seal fitting tightly around the end of the cable and the attachment end of the terminal, a tower seal including an elastomeric boot that is radially spaced from a contact of the terminal to sealingly engage a outer surface of an insulation tower for a mating terminal, and the cable seal including a sleeve portion of the elastomeric boot and a heat shrunk sleeve of insulative material.

10. The sealed ignition cable assembly as defined in claim 9 wherein a portion of the heat shrunk sleeve tightly engages an outer surface of the sleeve portion of the elastomeric boot.

11. A method of making a sealed ignition cable assembly comprising the steps of:

providing a subassembly comprising an ignition cable and a terminal having a contact end and an attachment end that is attached to an end of the ignition cable, inserting the subassembly in an oversize heat shrinkable sleeve of electrically insulative material so that the end of the ignition cable and the attachment end of the terminal is inside the sleeve, heat shrinking the sleeve so that it embraces the ignition cable and forms at least part of a cable seal for insulating a substantial portion of the terminal, and attaching an elastomeric boot so that it surrounds the contact portion of the terminal in a radially spaced relationship for sealing engagement with a periphery of an insulating tower for a mating terminal.

12. The method as defined in claim 11 wherein the sleeve is shrunk onto the ignition cable before the elastomeric boot is attached and the elastomeric boot is mounted on the heat shrunk sleeve.

13. The method as defined in claim 11 wherein the elastomeric boot is mounted on the ignition cable before the sleeve is shrunk onto the ignition cable and the shrunk sleeve fits tightly around an outer portion of the elastomeric boot.

14. A method of making a sealed ignition cable assembly comprising the steps of:

providing a subassembly comprising an ignition cable and a terminal having a contact end and an attachment end that is attached to a end of the ignition cable, inserting the subassembly in an oversize heat shrinkable sleeve of electrically insulative material so that the end of the ignition cable and the attachment end of the terminal is inside the sleeve, heat shrinking the sleeve so that it embraces the end of the ignition cable and the attachment end of the terminal in a substantially air tight arrangement, and attaching an elastomeric seal boot to the sleeve so that it surrounds the contact portion of the terminal in a radially spaced relationship for sealing engagement with a periphery of an insulating tower for a mating terminal.

15. The method as defined in claim 14 wherein the sleeve has a shape memory that is straight and the terminal is straight.

16. The method as defined in claim 14 wherein the heat shrunk sleeve has a curved portion that dresses the ignition cable at an angle.

17. The method as defined in claim 14 wherein the sleeve has a shape memory that includes a curved portion so that the ignition cable is dressed at an angle when the sleeve is shrunk onto the ignition cable.

18. The method as defined in claim 14 wherein the sleeve includes a spring or insert that has a shape memory that is curved so that the ignition cable is dressed at an angle when the sleeve is shrunk onto the ignition cable.

19. The method as defined in claim 16 wherein the terminal is straight.

20. The sealed ignition cable assembly as defined in claim 16 wherein the terminal has an angled transition between the attachment end and the contact end.

* * * * *